US005736088A

United States Patent [19]

Burke et al.

[11] Patent Number: 5,736,088

[45] Date of Patent: Apr. 7, 1998

[54] METHOD OF MAKING A PLASTIC KNUCKLE PIN

[75] Inventors: Michael K. Burke, Wheaton; John D. Anderson, Aurora, both of Ill.

[73] Assignee: Zeftek, Inc., Montgomery, Ill.

[21] Appl. No.: 715,082

[22] Filed: Sep. 19, 1996

Related U.S. Application Data

[62] Division of Ser. No. 622,961, Mar. 27, 1996, Pat. No. 5,630,519.

[51] Int. Cl.[6] ..... B29C 71/02; B61G 1/28

[52] U.S. Cl. ..... 264/237; 213/155; 264/348

[58] Field of Search ..... 411/508, 509, 411/510, 514, 913; 213/155; 264/235, 346, 234, 345, 237, 348

[56] References Cited

U.S. PATENT DOCUMENTS

| | | | |
|---|---|---|---|
| 577,389 | 2/1897 | Reagan . | |
| 2,311,524 | 2/1943 | Dillchay | 18/55 |
| 3,546,735 | 12/1970 | Liautaud | 16/128 |
| 3,850,902 | 11/1974 | Metcalfe et al. | 264/102 |
| 4,345,848 | 8/1982 | Cheselka | 403/157 |
| 4,756,053 | 7/1988 | Madden et al. | 16/223 |
| 4,957,386 | 9/1990 | Haley et al. | 403/231 |
| 4,971,500 | 11/1990 | Benoit et al. | 411/182 |
| 5,145,076 | 9/1992 | Murphy et al. | 213/155 |
| 5,226,808 | 7/1993 | Harley | 411/508 |
| 5,486,079 | 1/1996 | Martin et al. | 411/392 |
| 5,576,086 | 11/1996 | Narazaki et al. | 428/131 |
| 5,630,519 | 5/1997 | Burke et al. | 213/155 |

*Primary Examiner*—Jan H. Silbaugh
*Assistant Examiner*—Suzanne E. Mason
*Attorney, Agent, or Firm*—Lloyd L. Zickert

[57] ABSTRACT

An improved plastic knuckle pin for a coupler on a railway car and a method of making the improved plastic knuckle pin whereby the improved plastic knuckle pin has a substantially uniform material matrix and the method of making the pin increases uniformity in the material by increasing the surface cooling area which decreases air and moisture pockets in the material during the molding process.

9 Claims, 2 Drawing Sheets

METHOD OF MAKING A PLASTIC KNUCKLE PIN

This application is a division of application Ser. No. 08/622,961, filed Mar. 27, 1996, now U.S. Pat. No. 5,630, 519.

This invention relates in general to an improved plastic knuckle pin for a coupler on a railway car and a method of making an improved plastic knuckle pin, and more particularly to a plastic knuckle pin characterized by a substantially uniform material matrix and a method of making the pin which substantially increases uniformity in the material by increasing the surface cooling area of the material, thereby decreasing air and moisture pockets in the material during the molding process.

BACKGROUND OF THE INVENTION

Heretofore, it has been known to use plastic knuckle pins in couplers on railway cars, as disclosed in U.S. Pat. No. 5,145,076, the disclosure of which is incorporated by reference. The known plastic knuckle pins of the type shown in the patent are made from a self-lubricating plastic material exhibiting sufficient flexibility to absorb substantial bending stresses without breaking, thereby enhancing the life of the pins. While it is suggested in the above patent that the plastic knuckle pin may be hollow or made in more than one piece, it is disclosed to be preferably molded as a unitary solid piece. Plastic knuckle pins have been proven superior over steel knuckle pins because the plastic knuckle pin absorbs substantial bending stresses without breaking and therefore enjoys a longer life. Moreover, plastic knuckle pins are substantially lighter in weight and therefore easier to handle.

However, it has been found that the injection molding process used to form the known solid plastic knuckle pin creates some, if not a multitude of, liberties or trapped air pockets in the plastic pin. Further, if the solid plastic pin is made during humid weather, the plastic material tends to absorb moisture from the air during molding. Both of these phenomena result in a plastic knuckle pin having less than an optimal material matrix uniformity. It is therefore desirable to produce a solid plastic knuckle pin characterized by a substantially higher material matrix uniformity than the current known solid plastic knuckle pins.

SUMMARY OF THE INVENTION

The present invention provides an improved plastic knuckle pin for couplers on railway cars and a method of making the improved plastic knuckle pin characterized by a substantially uniform material matrix. More particularly, the plastic knuckle pin of the present invention includes a shaft or body, a head at one end of the shaft, spaced-apart annular relief areas on the shaft, and self-locking legs at the end of the shaft opposite the head. A series or plurality of holes or slots extend along opposite sides of the shaft in a symmetrical pattern. The placement or molding of these holes or slots, referred to generally as fluting, evenly increases the cooling surface area of the material and prevents the build-up of trapped air and moisture in the plastic material during the molding or forming process, thereby dramatically improving the overall uniformity of the plastic material and creating a more reliable plastic knuckle pin. Moreover, the fluting in the shaft also adds to relieve stress in the shaft when bending forces are exerted on the pin by the coupler.

The method of the present invention generally includes the steps of melting a suitable plastic material in a conventional manner to a temperature of approximately 450 degrees fahrenheit (232° C.), injecting or pouring the melted plastic material into a mold or tool maintained at a temperature of approximately 180 degrees fahrenheit (82° C.), molding or forming the plastic knuckle pin with fluting from the plastic material in the tool or mold for approximately two minutes, removing the knuckle pin from the tool or mold, placing the knuckle pin in a hot water bath maintained at a temperature of approximately 180 degrees fahrenheit for approximately 20 minutes, removing the knuckle pin from the hot water bath; and then allowing the knuckle pin to cool in air for approximately ten minutes. The cooling process is greatly enhanced by the fluting in the knuckle pin which increases the cooling surface area of the material, thereby better allowing trapped air and moisture to escape the plastic material and resulting in a more uniform and reliable plastic knuckle pin than previously known.

It is therefore an object of the present invention to provide an improved plastic knuckle pin for couplers on railway cars.

A further object of the present invention is to provide an improved plastic knuckle pin characterized by a substantially uniform material matrix.

A further object of the present invention is to provide an improved plastic knuckle pin having fluting in the shaft which relieves stress in the shaft when bending forces are exerted on the pin by the coupler.

A further object of the present invention is to provide an improved method of making a plastic knuckle pin.

A further object of the present invention is to provide a method of making a plastic knuckle pin having a fluted shaft which increases the cooling surface area of the material, thereby allowing trapped air and moisture to escape the plastic material, resulting in a more uniform and reliable plastic knuckle pin than previously known.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
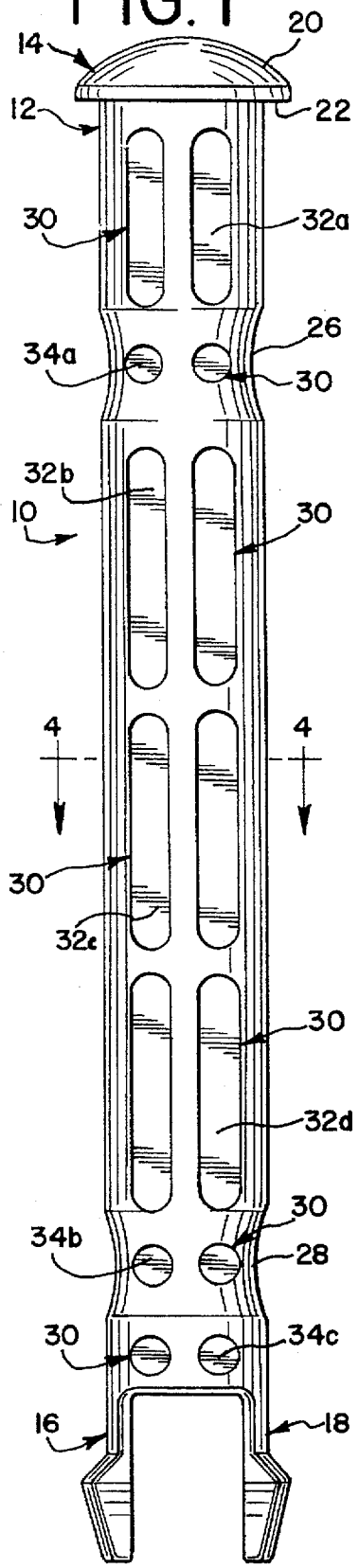
FIG. 1 is a front elevational view of the improved plastic knuckle pin of the present invention.
Figure 2:
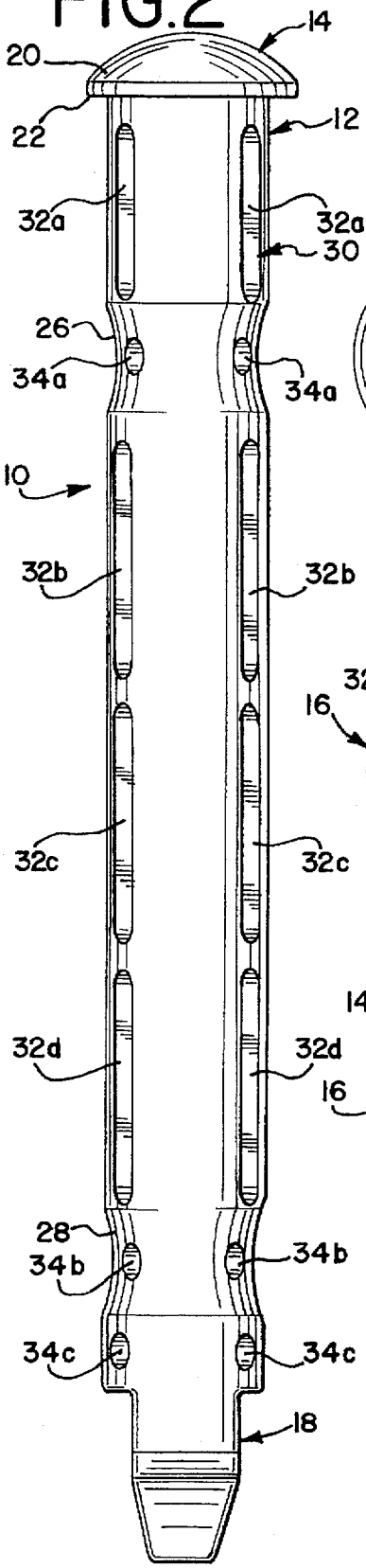
FIG. 2 is a side elevational view of the plastic knuckle pin.
Figure 3:
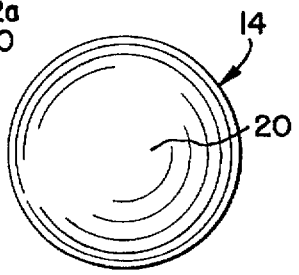
FIG. 3 is a top plan view of the plastic knuckle pin.
Figure 4:
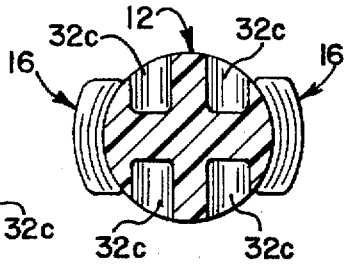
FIG. 4 is a cross-sectional view of the plastic knuckle pin taken substantially along line 4—4 of FIG. 1.
Figure 5:
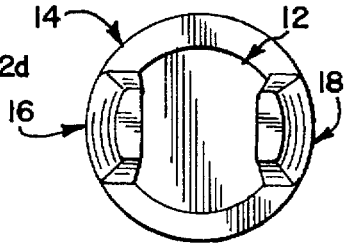
FIG. 5 is a bottom plan view of the plastic knuckle pin.

Knuckle pins are generally used in couplers for coupling two vehicles such as railway cars. The knuckle pin serves to pivotally interconnect the knuckle to the coupler body. A more detailed description and illustrations of a railway car coupler as well as the operation of a knuckle pin appear in U.S. Pat. No. 5,145,076.

Referring now to the drawings, and particularly to FIGS. 1 to 5, the knuckle pin of the present invention, generally indicated by numeral 10, includes a body or shaft 12, a head 14 at one end of the shaft 12, and self-locking coacting legs 16 and 18 at the end of the shaft 12 opposite the head 14. The plastic knuckle pin of the present invention is preferably a solid piece of molded urethane or polyurethane, as further described below. The urethane material provides the desired flexibility to enable the pin to absorb significant bending forces placed on the pin by the coupler without fatigue, thereby substantially reducing pin failure. It will be appreciated that other suitable plastic materials could be used as suggested by U.S. Pat. No. 5,145,076.

The head 14 of the pin 10 includes a somewhat dome-shaped upper end 20 which is sized diametrically larger than a pin opening in a coupler. The upper end 20 is also diametrically larger than the shaft 12 to define an annular shoulder 22. For reinforcement purposes, an annular radius (not shown) may be formed between the head 14 and the shaft 12 to guard against head damage from mallet blows during installation and to avoid sharp corners in the pin 10.

At the end of the shaft opposite the head, two self-locking legs 16 and 18 coact to lock the pin 10 in the coupler. The self-locking legs 16 and 18 are compressed together or toward each other as the pin is driven into the pin opening in the coupler and expand or snap apart when the pin is fully inserted in the coupler. In a conventional manner, the pin is prohibited from being removed because the outer ends of the legs are radially larger than the pin opening. Alternatively, a cotter pin hole and cotter pin may be used to lock the pin in place. Other suitable locking devices could also be used.

The shaft or body 12 is generally cylindrical in shape and preferably includes upper and lower relief areas 26 and 28 having an outer diameter smaller than the shaft for relieving stress. The shaft 12 also has a series or plurality of holes or slots 30 symmetrically positioned along opposite sides of the shaft. The holes or slots 30, referred to as longitudinal fluting in the shaft, are round or oval, although the holes or slots may be formed in other shapes. Preferably, there are four pairs of oval slots 32*a*, 32*b*, 32*c*, and 32*d* positioned along each side of the shaft and three pairs of round slots 34*a*, 34*b*, and 34*c* positioned along each side of the shaft. More specifically, on opposite sides of the shaft two pairs of oval slots 32*a* are positioned in the shaft between the head 14 and the upper relief area 26, two pairs of round slots 34*a* are centrally positioned in the upper relief area 26, six pairs of oval slots 32*b*, 32*c*, and 32*d* are positioned in the shaft between the upper and lower relief areas 26 and 28, two pairs of round slots 34*b* are centrally positioned on the shaft in the lower relief area 28, and two pairs of round slots 34*c* are positioned in the shaft between the lower relief area 28 and the self-locking legs 16 and 18.

The placement of the slots or fluting in the shaft increase the cooling surface area of the plastic material during the molding process, thereby allowing air and moisture to escape the material during the molding process. Furthermore, the slots or fluting in the shaft relieves stress in the shaft in use when bending forces are exerted on the pin by the coupler. The fluting allows the material to work or bend more without breaking. In particular, there are greater compression paths provided by the slots, especially in the upper and lower relief areas. Two related advantages provided by the improved knuckle pin of the present invention are that less material is needed to make the pin, resulting in material cost savings and resulting in a lighter weight pin.

Figure 6:
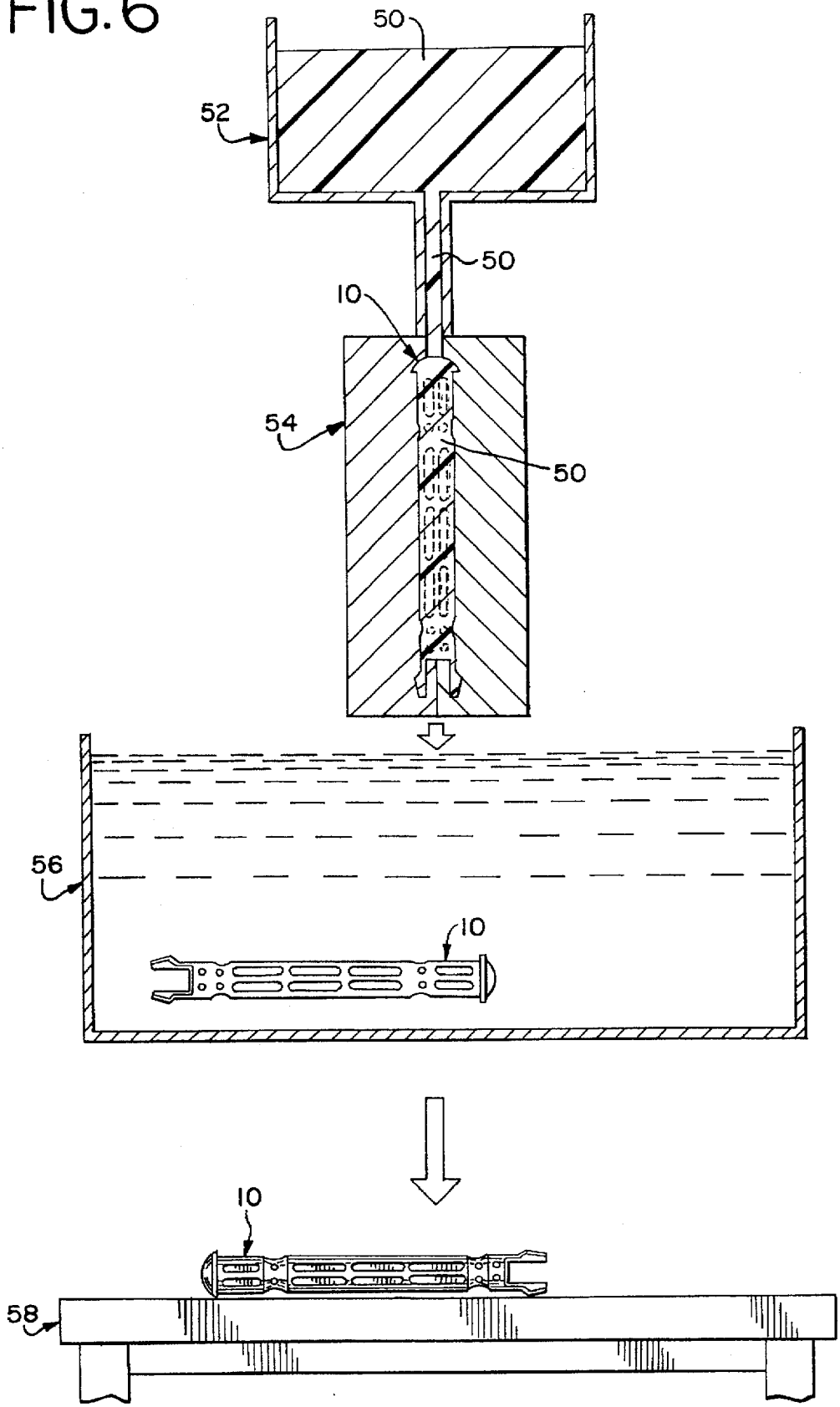
FIG. 6 is a generally schematic view depicting the improved method of making the plastic knuckle pin of the present invention.

Referring now to FIG. 6, the improved method of molding the plastic knuckle pin of the present invention is schematically illustrated. The plastic knuckle pin is preferably made from urethane, black in color, and more specifically, an unfilled polyurethane. According to the method of the present invention, the unfilled urethane or other plastic raw material 50 is first melted in a tank or reservoir 52 at a temperature of approximately 450 degrees fahrenheit (232° C.) in a conventional manner. The molten plastic material 50 is then injected or poured into a mold or tool 54 maintained at a temperature of approximately 180 degrees fahrenheit (82° C.). The tool 54 is maintained at the appropriate temperature by circulating fluid (not shown) in the mold. Other methods could be used to maintain the tool at the appropriate temperature. The plastic material 50 is maintained in the mold 54 for approximately two minutes to reduce the temperature and allow the plastic to sufficiently harden so it can be removed from the mold. The plastic knuckle pin 10 is thus formed with fluting or slots 30 along opposite sides of the shaft 12.

The knuckle pin 10, which comes out of the mold at approximately 200 degrees fahrenheit (93° C.), is then removed from the mold 54 and placed or dropped in a hot water bath 56 maintained at a temperature of approximately 180 degrees fahrenheit (82° C.). The pin is allowed to cool in the hot water bath 54 for approximately 20 minutes. This cooling period relieves any stresses that may build up during the molding process. The pin 10 is then removed from the hot water bath and placed on a cooling surface 58 where the pin is allowed to cool in air for approximately ten minutes.

The slots or fluting in the shaft of the pin 10 improves the material flow in the mold cavity and provides a significantly greater cooling surface area for the pin which greatly enhances the cooling process. Further, the fluting allows air and moisture to escape the material as it cools, and enhances injection of the material into the mold. The improved method of the present invention unexpectedly provides a more uniform and reliable plastic knuckle pin than previously known which is easier to mold. Approximately thirty shots an hour can be made with the appropriate method in a single mold.

It will be understood that modifications and variations may be effected without departing from the scope of the novel concepts of the present invention, but it is understood that this application is to be limited only by the scope of the appended claims.

The invention is hereby claimed as follows:

1. A method of making a plastic knuckle pin for a coupler on a railway car, wherein the pin includes a shaft with fluting along its length to increase the surface area of the pin and a head at one end, said method comprising the steps of (a) melting a suitable plastic raw material;

(b) injecting said melted plastic material into a mold;

(c) forming a knuckle pin having fluting from said plastic material in said mold;

(d) removing said knuckle pin from said mold;

(e) placing said knuckle pin in a hot water bath;

(f) removing said knuckle pin from said hot water bath and allowing said knuckle pin to be cooled therein;

(g) allowing said knuckle pin to be cooled in air, wherein said fluting increases the surface area of the pin being cooled to enhance cooling, thereby reducing stresses and resulting in a plastic knuckle pin having a substantially uniform matrix.

2. The method of making a knuckle pin of claim 1, wherein the material is heated to a temperature of approximately 450 degrees fahrenheit in step (a).

3. The method of making a knuckle pin of claim 1, wherein the mold is maintained at a temperature of approximately 180 degrees fahrenheit.

4. The method of making a knuckle pin of claim 3, wherein the mold is heated by circulating high-temperature fluid in the mold.

5. The method of making a knuckle pin of claim 1, wherein said plastic material is in said mold for approximately two minutes.

6. The method of making a knuckle pin of claim 1, wherein the hot water bath is maintained at a temperature of approximately 180 degrees fahrenheit.

7. The method of making a knuckle pin of claim 1, wherein the plastic knuckle pin is placed in the hot water bath for approximately 20 minutes.

8. The method of making a knuckle pin of claim 1, wherein the plastic knuckle pin is cooled in air for approximately ten minutes.

9. A method of making a knuckle pin for a coupler on a railway car, wherein the pin includes a shaft with fluting along its length to increase the surface area of the pin and a head at one end, said fluting including longitudinally extending and circumferentially arranged slots, said method comprising the steps of (a) melting a suitable plastic raw material to a temperature of approximately 450 degrees fahrenheit;

(b) injecting said melted plastic material into a tool maintained at a temperature of approximately 180 degrees fahrenheit;

(c) forming a knuckle pin having fluting from said plastic material in said tool, maintaining said material in said tool for approximately two minutes;

(d) removing said knuckle pin from said tool;

(e) placing said knuckle pin in a hot water bath maintained at a temperature of approximately 180 degrees fahrenheit for approximately 20 minutes and allowing said knuckle pin to be cooled therein;

(f) removing said knuckle pin from said hot water bath;

(g) allowing said knuckle pin to be cooled in air for approximately ten minutes, wherein said fluting increases the surface area of the pin being cooled to enhance cooling thereby reducing stresses and forming a plastic knuckle pin having a substantially uniform matrix.

* * * * *

UNITED STATES PATENT AND TRADEMARK OFFICE

CERTIFICATE OF CORRECTION

PATENT NO. : 5,736,088

DATED : April 7, 1998

INVENTOR(S) : Michael K. Burke and John D. Anderson

It is certified that error appears in the above-indentified patent and that said Letters Patent is hereby corrected as shown below:

Col. 4, line 51, after "bath" and before the semi-colon (;) insert --and allowing said knuckle pin to be cooled therein--
line 52, after "bath" insert a semi-colon (;)
line 53, delete entire line.

Signed and Sealed this

Twenty-third Day of June, 1998

*Attest:*

*Attesting Officer*

BRUCE LEHMAN

*Commissioner of Patents and Trademarks*